US011697194B2

(12) United States Patent
Roehm et al.

(10) Patent No.: US 11,697,194 B2
(45) Date of Patent: Jul. 11, 2023

(54) METHOD FOR CONTROLLING OR REGULATING A HAND-HELD POWER TOOL

(71) Applicant: Robert Bosch GmbH, Stuttgart (DE)

(72) Inventors: Heiko Roehm, Stuttgart (DE); Arne Christ, Stuttgart (DE); Dietmar Saur, Moessingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 61 days.

(21) Appl. No.: 17/278,156

(22) PCT Filed: Sep. 11, 2019

(86) PCT No.: PCT/EP2019/074185

§ 371 (c)(1),
(2) Date: Mar. 19, 2021

(87) PCT Pub. No.: WO2020/064330

PCT Pub. Date: Apr. 2, 2020

(65) Prior Publication Data

US 2021/0370483 A1 Dec. 2, 2021

(30) Foreign Application Priority Data

Sep. 28, 2018 (DE) ..... 102018216702.8

(51) Int. Cl.
*B25B 21/02* (2006.01)
*B25B 23/14* (2006.01)

(52) U.S. Cl.
CPC ..... *B25B 21/02* (2013.01); *B25B 23/1405* (2013.01)

(58) Field of Classification Search
CPC ... B25B 21/02; B25B 23/1405; B25B 21/026; B25B 21/008; B25F 5/001
See application file for complete search history.

(56) References Cited

U.S. PATENT DOCUMENTS

2011/0162860 A1* 7/2011 Gut ..... B25F 5/001 173/1
2013/0000934 A1* 1/2013 Tadokoro ..... B25B 21/00 173/90

(Continued)

FOREIGN PATENT DOCUMENTS

CN 101466501 A 6/2009
DE 10001459 A1 7/2001

(Continued)

OTHER PUBLICATIONS

International Search Report for PCT/EP2019/074185, dated Feb. 19, 2020.

*Primary Examiner* — Andrew M Tecco
*Assistant Examiner* — Nicholas E Igbokwe
(74) *Attorney, Agent, or Firm* — Norton Rose Fulbright US LLP; Gerard Messina

(57) ABSTRACT

A method for controlling or regulating a hand-held power tool, in particular a screwdriver, preferably a rotary impact screwdriver. The method includes: application of a first torque, in particular torque impulse, to a screw in a first direction of rotation, and application of a second torque, in particular torque impulse, to the screw, in a second direction of rotation opposite to the first direction of rotation.

23 Claims, 3 Drawing Sheets

(56) References Cited

U.S. PATENT DOCUMENTS

| | | | | |
|---|---|---|---|---|
| 2013/0014967 | A1* | 1/2013 | Ito | B25F 5/00 173/93 |
| 2017/0173768 | A1* | 6/2017 | Dey, IV | B25B 23/1475 |
| 2018/0222022 | A1* | 8/2018 | Kumagai | B25D 11/04 |

FOREIGN PATENT DOCUMENTS

| | | | |
|---|---|---|---|
| DE | 102014108398 | A1 | 12/2015 |
| EP | 445084 | A2 | 9/1991 |
| EP | 2338646 | A2 | 6/2011 |
| EP | 3170624 | A1 | 5/2017 |
| GB | 2175231 | A | 11/1986 |
| WO | 2009102082 | A2 | 8/2009 |
| WO | 2011122695 | A1 | 10/2011 |
| WO | 2016195899 | A1 | 12/2016 |

* cited by examiner

METHOD FOR CONTROLLING OR REGULATING A HAND-HELD POWER TOOL

FIELD

The present invention relates to a method for controlling or regulating a hand-held power tool.

BACKGROUND INFORMATION

German Patent Application No. DE 100 01 459 B4 describes an electrical tool, in particular a drill or screwdriver, having an actuating switch for applying a motor voltage, which is a function of the desired rotational speed, to a drive motor having a stator and an armature, and having a device for changing the direction of rotation of the drive motor, an angular position of a brush rocker that holds a carbon brush being modified, and the polarity of the stator field being reversed.

SUMMARY

An object of the present invention is to improve, using simple constructive measures, a method for controlling or regulating a hand-held power tool.

The object is achieved in accordance with an example embodiment of the present invention by providing a method for controlling or regulating a hand-held power tool, in particular a screwdriver, preferably a rotary impact screwdriver, having at least the following steps:

- applying a first rotational torque, in particular a rotational torque impulse, to a screw means (i.e., a screw) in a first direction of rotation, and
- applying a second rotational torque, in particular a rotational torque impulse, to the screw means in a second direction of rotation opposite to the first direction of rotation.

Using the method according to the present invention, a hand-held power tool can tighten or screw in a screw means in a particularly advantageous manner. In particular, a hand-held power tool can be prevented from getting jammed on the screw means so that an operator of the hand-held power tool is prevented from removing the hand-held power tool from the screw means. Using the method according to the present invention, an operator of a hand-held power tool can work particularly reliably and efficiently.

The method according to the present invention includes in particular an application of a torque to a screw means. In order to screw in a screw means, here a torque is applied to the screw means in a first direction of rotation in order to tighten the screw for example to a desired depth or a desired torque. In a screwing-in process, the screw means can be tightened in such a way that the hand-held power tool, in particular a torque-transmitting region of the hand-held power tool, becomes jammed with the screw means. A jamming can be produced by an elastic deformation and a subsequent tensioning of the hand-held power tool, in particular of the torque-transmitting region of the hand-held power tool, relative to the screw means, and is promoted in particular by increasing wear of the hand-held power tool, in particular of the torque-transmitting region. Releasing the tension can be very difficult and time-consuming, and may cause damage to the hand-held power tool due to excess loading of the hand-held power tool in the direction radial to a driven shaft. Releasing the jam may also require an additional tool.

In order to release such a jamming, a second torque can be applied to the screw means that acts in a second direction of rotation opposite to the first direction of rotation. For example, the second torque in the second direction of rotation can be carried out for the simple release of a connection of the hand-held power tool, in particular of the torque-transmitting region of the hand-held power tool, with the screw means.

An opposite direction of rotation is in particular a direction that acts oppositely in relation to a reference direction of rotation as considered about an axis of rotation, such as in the case of a rotation to the left relative to an axis of rotation if the reference direction of rotation corresponds to a rotation to the right relative to the axis of rotation.

The first direction of rotation can be clockwise. The second direction of rotation can be counterclockwise. The first direction of rotation and the second direction of rotation are opposed to one another.

In particular, a release of the jam should take place while avoiding a reduction of a tightening torque, or of a target torque, of the screw means in the first direction of rotation.

The torque-transmitting region can be realized as a screwdriver bit that is capable of being coupled to a driven unit of the hand-held power tool. The screwdriver bit can be realized as a socket attachment. The screwdriver bit can have a hexagonal cross-section. However, screwdriver bits having a rectangular cross-section, an octagonal cross-section, or some other cross-section are also possible. The screwdriver bit can be provided so as to surround the screw means by 360°, in at least one plane, in the coupled state. The torque-transmitting region can be provided on the driven unit of the hand-held power tool. The screwdriver bit can be realized as a nut, in particular as a hexagonal nut.

A changeover from a first torque to a second torque takes place via a reversal of the direction of rotation. The reversal of the direction of rotation can be brought about in a manner that appears appropriate to someone skilled in the art, such as via an electrical controlling of a drive unit or via a coupling. For example, the reversal of the direction of rotation can take place via an actuation of a rotational direction switch by an operator of the hand-held power tool.

Alternatively or in addition, the hand-held power tool can have an impact mechanism, in particular a rotary impact mechanism, that is provided to ensure an impact operation, in particular a rotary impact operation, of the hand-held power tool. Here, the hand-held power tool can form a rotary impact impulse that can be transmitted to the screw means.

Alternatively or in addition, an axial and/or radial impact impulse can be provided to release the jamming of the screw means.

The application of the first torque and/or the second torque to the screw means can take place at least partly via a first torque impulse and/or a second torque impulse. Of course, there may be a plurality of torque impulses. The torque impulses can run periodically. The torque impulses can have a pulse frequency between 0.1 and 100 Hz. The torque impulses can form torque impacts in the circumferential direction, i.e., in the first direction of rotation and/or in the second direction of rotation. The torque impulses can form a torque that is applied briefly and in the manner of an impulse, acting on the screw means. A screw-in process of the screw means can comprise a plurality of torque impulses.

In particular, the hand-held power tool is realized as a drill screwdriver or as a rotary impact screwdriver. Of course, other hand-held power tools that appear appropriate to a person skilled in the art appropriate may also be considered. The hand-held power tool preferably has a drive unit. The drive unit is provided to transmit a movement, in particular a rotary movement, to a driven unit, in particular a torque-transmitting region.

Further useful developments and embodiments of the method according to the present invention are disclosed herein.

It can be useful for the method to include an application of one or a plurality of first torque impulses to the screw means in the first direction of rotation. The torque impulses in the first direction of rotation can be provided to set the screw means into rotation and preferably to screw the screw means into a workpiece. A screwing process of a screw means can include a plurality of in particular, downstream torque impulses that are provided to connect or screw the screw means to the workpiece. The torque impulses can be provided to support a screw-in process of a screw means, for example by facilitating the screw-in process of the screw means in the case of higher torques, or target torques, that are to be applied to the screw means. For example, more than two, in particular more than three, preferably more than four, preferably more than five, particularly preferably more than 50, further preferably more than 100, further particularly preferably more than 1000 torque impulses can be provided. In this way, the screw means can be screwed into a workpiece particularly reliably.

In addition, it can be useful for the method to include an application of one or a plurality of second torque impulses to the screw means in the second direction of rotation. In particular, one single or two second torque impulse(s) can be provided that act in the second direction of rotation. Preferably, more than two second torque impulses can be provided that act in the second direction of rotation. In particular, after, or immediately after, the termination of the first torque/rotary impulse, or of the screw-in process in the first direction of rotation, the second torque/rotary impulse can take place in the second direction of rotation. In this way, after a screw-in process has taken place the screw means can be particularly easily decoupled from the hand-held power tool. In this way, in a particularly advantageous manner impulse energy can be used to enable the particular technical effect.

In addition, it can be useful to set a number of torque impulses in the first and/or second direction of rotation. Here the number of torque impulses that are to be applied to the screw means can be set. In particular, here the screw means can be prevented from detaching when a second torque in the second direction of rotation is applied to the screw means.

In addition, it can be useful for the application of the second torque, in particular second torque impulse, to the screw means in the second direction of rotation to take place as a function of an actuation, in particular an activation or a deactivation, of an actuating element for controlling or regulating a drive unit of the hand-held power tool. In particular, the actuating element is provided to control or to regulate the drive unit. In the case of an actuation, in particular an activation, of the actuating element, the drive unit can be controlled or regulated in such a way that the driven unit applies the first torque to the screw means in the first direction of rotation. In the case of an actuation, in particular a deactivation, of the actuating element, the drive unit can be controlled or regulated in such a way that the driven unit applies the second torque to the screw means in the second direction of rotation, in particular before the drive unit is deactivated due to the deactivation of the actuating element. For example, a compressed actuating element can be provided to tighten or screw in the screw means. For example, a released, or non-compressed, actuating element can be provided to reverse the direction of rotation, in particular to apply a second torque to the screw means in the second direction of rotation. For example, a released actuating element can be provided to apply a second torque, acting opposite to the first torque, to the screw means. The actuating element can be released for example upon termination of the screw process. Alternatively or in addition, the application of the second torque, in particular torque impulse, to the screw means in the second direction of rotation can take place as a function of a kickback activation, of reaching a target torque in the first direction of rotation, and/or of an e-clutch activation. The application of the second torque, in particular torque impulse, or of the reversal of direction of rotation, to the screw means can here take place as a function of an angle of rotation that has been traveled through, a torque, an impulse, and/or a current strength. In this way, a jamming can be released in a particularly simple and/or automatic manner.

In accordance with an example embodiment of the present invention, the application of the second torque, in particular torque impulse, to the screw means in the second direction of rotation takes place as a function in particular of an activation of a rotary impact function of the hand-held power tool. In particular, when a rotary impact function is used, the risk of jamming is great. In order to prevent such jamming, when the rotary impact function is used, the second torque is preferably applied to the screw means in the second direction of rotation after each actuation process or screwing process of the hand-held power tool.

In addition, in accordance with an example embodiment of the present invention, it is provided that the method comprise a provision of a first target torque for limiting an application of the first torque, in particular torque impulse, to the screw means in the first direction of rotation. The first torque and/or the first target torque can be acquired electronically, for example by at least one sensor unit of the hand-held power tool. For example, the torque can be measured via a physical variable, such as an amount of energy, in particular a current strength, with which the drive unit is operated. In this connection, the first target torque should form an assembly torque that is in particular a target state of the screw means. In particular, here a first torque in the first direction of rotation should be applied to the screw means until the first target torque is reached. In this way, it can be ensured that specified tightening torques of the screw means are not exceeded.

It is further proposed that the method include an application of the second torque, in particular torque impulse, to the screw means in the second direction of rotation as a function of, in particular, a reaching of the first target torque in the first direction of rotation. In particular, a torque in a second direction of rotation can be applied to the screw means if, or after, the screw means has, with the first torque in the first direction of rotation, reached or exceeded the first target torque. After reaching or exceeding the first target torque, the direction of rotation can be changed in order to prevent jamming, by applying a second torque in the second direction of rotation to the screw means. The direction of rotation can be electronically changed over using an electronic changeover unit. For example, the polarity of the drive unit can be reversed. In this way, jamming can be preventively guarded against after each screw process.

It can be useful for the second torque, in particular torque impulse, in the second of direction rotation to be capable of being activated or deactivated, in particular by a switching button or an external device. In this way, the intended application of the second torque to the screw means in the second direction of rotation can be deactivated or activated, in particular mechanically. In this way, as needed the operator can activate a function that releases a jamming.

In addition, it can be useful for the method to include a provision of a time duration of the second torque, in particular torque impulse, acting on the screw means in the second direction of rotation. For example, the drive unit can be switched off if the second torque in the second direction of rotation is applied to the screw means with a time duration of longer than 1 s, in particular longer than 2 s, preferably longer than 3 s, further preferably longer than 4 s, preferably longer than 5 s, and/or less than 10 s, in particular less than 8 s, preferably less than 5 s, and/or less than 3 s, in particular less than 1 s, preferably less than 0.1 s. Here "s" stands for seconds.

In addition, it can be useful for the method to include a provision of a second target torque for limiting an application of the second torque, in particular torque impulse, to the screw means in the second direction of rotation. The second target torque is intended to form in particular a maximum second torque, in particular torque impulse, acting on the screw means in the second direction of rotation. The second target torque can be set in particular as a function of the first torque in the first direction of rotation. In this way, application-specific values can be set.

In addition, it can be useful for the second torque, in particular torque impulse, to be smaller relative to the first torque, in particular torque impulse. In particular, the first target torque in the first direction of rotation should be larger than the second target torque in the second direction. In this way, a screw connection can be prevented from detaching when the second torque in the second direction of rotation is applied to the screw means. Preferably, the second torque, in particular torque impulse, is smaller relative to the first torque, in particular torque impulse, by up to 95%, in particular up to 90%, preferably up to 80%, preferably up to 70%, particularly preferably up to 50%. Preferably, the second torque, in particular torque impulse, is smaller relative to the first torque, in particular torque impulse, by at least 50%, in particular at least 60%, preferably at least 70%, preferably at least 80%. Of course, in an alternative specific embodiment the second torque may also be larger in relation to the first torque. Here, a jamming of the hand-held power tool relative to the screw means can be prevented in a particularly simple manner.

In particular, the first target torque, in particular torque impulse, reproduces the final torque, i.e., final torque before the reversal of direction of rotation, acting on the screw means. Preferably, the second target torque, in particular torque impulse, reproduces the first torque, i.e., the first torque after the reversal of direction of rotation.

In accordance with an example embodiment of the present invention, it is provided that the second target torque, in particular torque impulse, deviates from or is smaller relative to the first target torque, in particular torque impulse, by up to 50%, in particular up to 40%, preferably up to 30%, preferably up to 20%, particularly preferably up to 10%, and/or at least 10%.

In addition, in accordance with an example embodiment of the present invention, it is provided that a rotational movement in the second direction of rotation takes place with an angle of rotation of up to 20°, in particular up to 15°, preferably up to 10°, preferably up to 8°, particularly preferably up to 5°. In particular, angle of rotation $\varphi$ is greater than 1°, in particular greater than 2°, preferably greater than 5°, preferably greater than 8°, particularly preferably greater than 10°. A rotational movement can be understood as a movement of the driven unit, in particular of the torque-transmitting unit, relative to the screw means. In particular, a corresponding joint clearance of the driven unit, in particular of the torque-transmitting unit, relative to the screw means can be exploited in order to enable a rotational movement of the driven unit, in particular of the torque-transmitting unit, in the second direction of rotation without detaching the screw means with a second torque. In this way, a degree of play of the driven unit, in particular of the torque-transmitting region, relative to the screw means in the second direction of rotation can be exploited in a particularly reliable manner.

In addition, the present invention relates to a hand-held power tool for carrying out the method.

In accordance with an example embodiment of the present invention, it can be useful for the hand-held power tool to have a communication unit for receiving data from an external device and for setting the data of the hand-held power tool.

The communication unit can be provided in order to wirelessly control or regulate the drive unit. The communication unit can have a first communication module that is situated on or in an actuating unit, or the actuating element. The communication unit can have a second communication module situated on or in the drive unit. Of course, the second communication module is connected to the electronics unit. The electronics unit can be provided to control or to regulate the drive unit. The electronics unit can be connected to the second communications module, in particular electrically, or by electrical lines. In addition, it can be useful for the hand-held power tool to have at least one communication unit for a communication with at least one external unit for an exchange of electronic data at least for a controlling or regulating of the drive unit. The communication unit is preferably realized as a wireless communication unit. The communication unit can be realized as a WLAN communication unit, as a Bluetooth communication unit, as a radio communication unit, as an RFID communication unit, as an NFC unit, as an infrared communication unit, as a mobile radiotelephone network communication unit, or the like. Particularly preferably, the electronics unit is provided to control or to regulate the drive unit and/or safety functions as a function of an actuation of the actuating unit and as a function of electronic data transmitted to the electronics unit by the communication unit. Particularly preferably, the communication unit is provided for a bidirectional data transmission. In an alternative embodiment, the communication unit is realized as a wire-bound communication unit, for example as an LAN communication unit, as a USB communication unit, or the like. The external unit is preferably realized as a smartphone that has an app for communication with the communication unit. However, it is also possible for the external unit to be realized as an external, transportable actuating unit, as a fixedly installed actuating unit at a workplace of an operator, as a synchronization unit, fixedly installed in a room, of a location of use that can be controlled from a central instance, for example as a result of company specifications/safety regulations, as a unit for monitoring body parameters of an operator, as an external sensor unit, or as some other central or decentral actuating unit, input station, and/or central or decentral terminal, as considered appropriate by a person skilled in the art. In this way, a synchronization of electronic data can advantageously be enabled. If for example the hand-held power tool is set into operation in a synchronization mode, for example by plugging in an accumulator device, plugging in a power supply cable, or through activation by an operator, a connection is set up at least partly automatically between the communication unit and the external unit. Settings stored in the external unit are in this way preferably directly transmissible to the hand-held power tool. These can be individual settings of an operator, such as a desired rapid run-up to a set rotational speed and a maximum power level, and/or specifications of a company, such as maintaining a safety function within a specified area of company premises or a location of use, etc.

BRIEF DESCRIPTION OF THE DRAWINGS

Further advantages result from the description below of the figures. The figures show exemplary embodiments of the present invention. The figures and the description contain numerous features in combination. The person skilled in the art will also usefully regard the features individually and combine them to form appropriate further combinations, in view of the disclosure herein.

DETAILED DESCRIPTION OF EXAMPLE EMBODIMENTS

Figure 1:
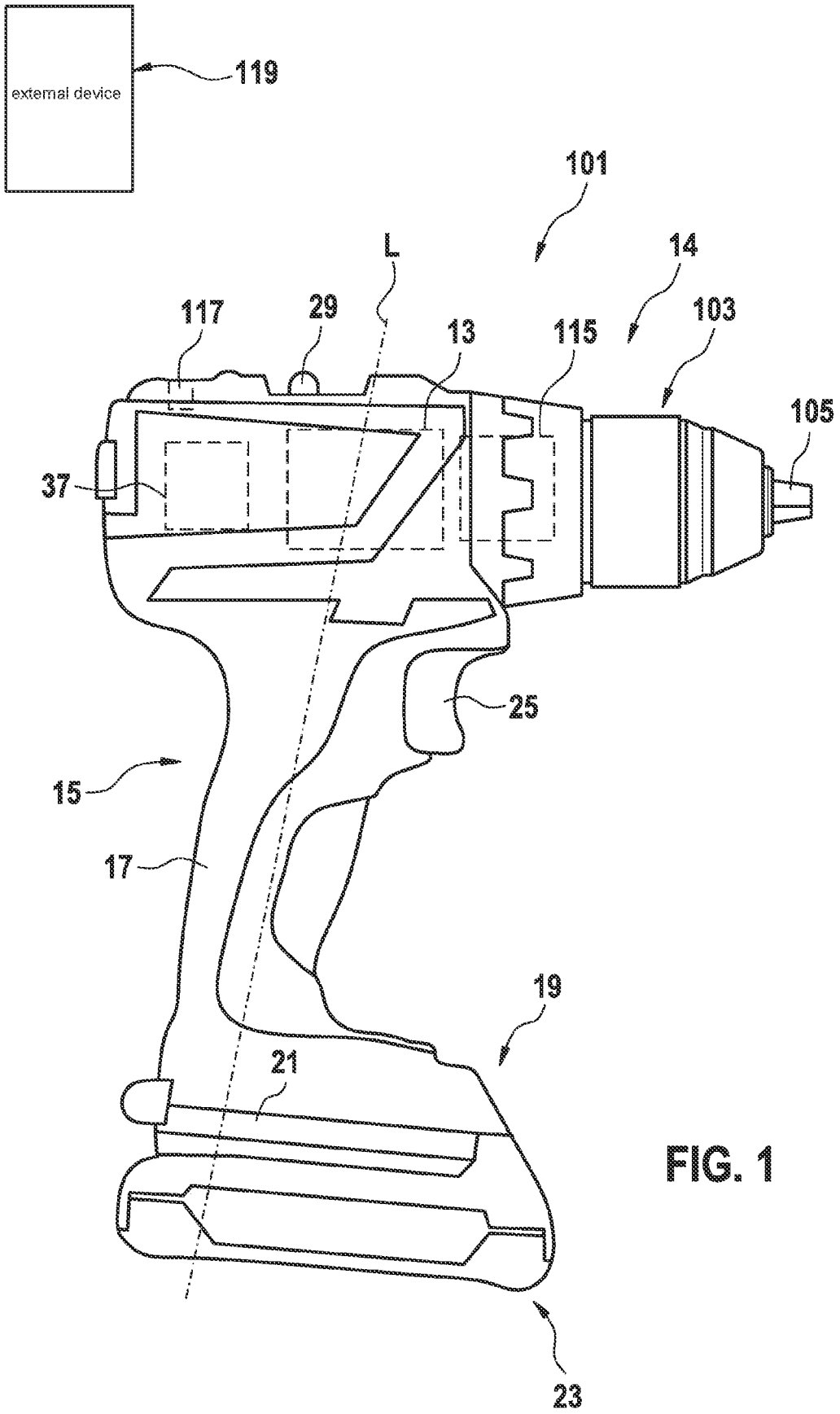
FIG. 1 shows a perspective view of a hand-held power tool.
Figure 2:
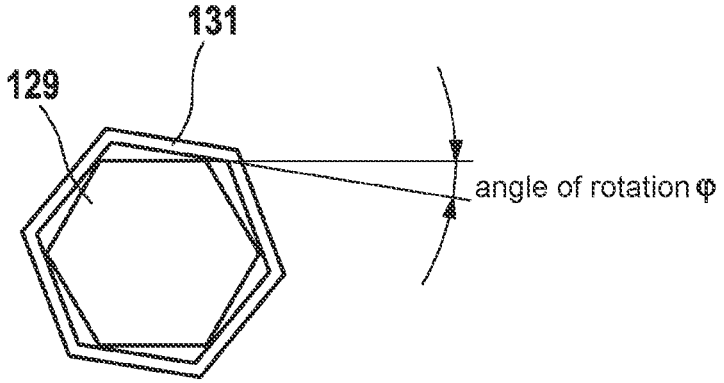
FIG. 2 shows a cross-section of a torque-transmitting region and of the screw means.

In the Figures, identical components are provided with the same reference characters.

The Figures each relate to a hand-held power tool 101 having a receptacle unit 103 for accepting tool attachments (not shown), such as a screwdriver bit, fashioned as a hexagonal nut, for screwing screws into a workpiece. Receptacle unit 103 has a conventional clamping device 105 that is provided in order to hold the tool attachment in or on hand-held power tool 101.

Hand-held power tool 101 is in particular a battery-operated screwdriver, in particular a battery-operated drill screwdriver or a battery-operator rotary impact screwdriver.

FIG. 1 shows hand-held power tool 101 having a drive unit 13, in particular a drive shaft (not shown) for transmitting a movement to a driven unit 14, in particular a driven shaft (not shown) of driven unit 14. Drive unit 13 is provided in particular to transmit a movement of drive unit 13 to a tool attachment (not shown). Drive unit 13 has an electric motor 13 realized as an electronically commutated direct-current motor. Driven unit 14 includes receptacle unit 103 and clamping device 105.

Hand-held power tool 101 has a machine housing realized at least partly as a handle casing 15 that forms an external housing 17 of hand-held power tool 101. Handle casing 15 is provided in order to be grasped by a hand of an operator of hand-held power tool 101.

In addition, hand-held power tool 101 has an interface unit 19 having a holding unit 21 that can be detachably fastened to a battery unit 23. Holding unit 21 is provided to hold battery unit 23 in a fastened state, connected to hand-held power tool 101. In addition, machine housing 15 has an actuating element 25 for switching on an off and on/off switch 25 on drive unit 13, and has a gearing unit (not shown) preferably realized as a planetary gearing. The gearing unit includes at least two gears switchable by a switching button 29.

In addition, hand-held power tool 101 has a rotary impact mechanism (not shown in more detail) that is provided to apply rotary impact impulses to the screw means (i.e., the screw) in order to screw in the screw means.

Machine housing 15 further includes a holding unit 21 that at least in some segments forms an external housing 17. Machine housing 15 is substantially made of plastic. Machine housing 15 is made with a shell construction. Holding unit 21 bounds hand-held power tool 101 from a side of the handle casing oriented away from drive unit 13. Holding unit 21 is made of metal. Holding unit 21 is fashioned as a holding clip 21.

In a fastened state, battery unit 23 is connected with hand-held power tool 101, so that there is an electrical contact of battery unit 23 with drive unit 13 of hand-held power tool 101 when battery unit 23 is connected to interface unit 19. Battery unit 23 supplies hand-held power tool 101 with electrical energy. At least battery pack 23, drive unit 13, on/off switch 25, and electronics unit 37 are electrically connected by lines 43.

Hand-held power tool 101 additionally has a mechanical coupling unit 115 for coupling the driveshaft of drive unit 13 to the driven shaft of driven unit 14. Coupling unit 115 has at least one slip clutch. Coupling unit 115 can be coupled to the gearing unit. Coupling unit 115 can be realized as an adjustable torque coupling by which a torque can be manually set. For example, a maximum torque of 100 Nm or 200 Nm or 1000 Nm can be set in order to encompass a preferred torque range from 0.1 to 20 Nm, so that in particular coupling unit 115 is set into a clutch slipping state when this torque is exceeded.

Hand-held power tool 101 has an electronics unit 37 that is set up to regulate drive unit 13.

Electronics unit 37 can acquire the torque directly via an acceleration sensor provided for this purpose, and/or indirectly, for example via a measurement of the current strength of drive unit 13, which behaves substantially proportionally to the torque of drive unit 13. Electronics unit 37 has a computing unit, such as a microcontroller, for reading out and/or processing the torque and the direction of rotation.

Figure 3:
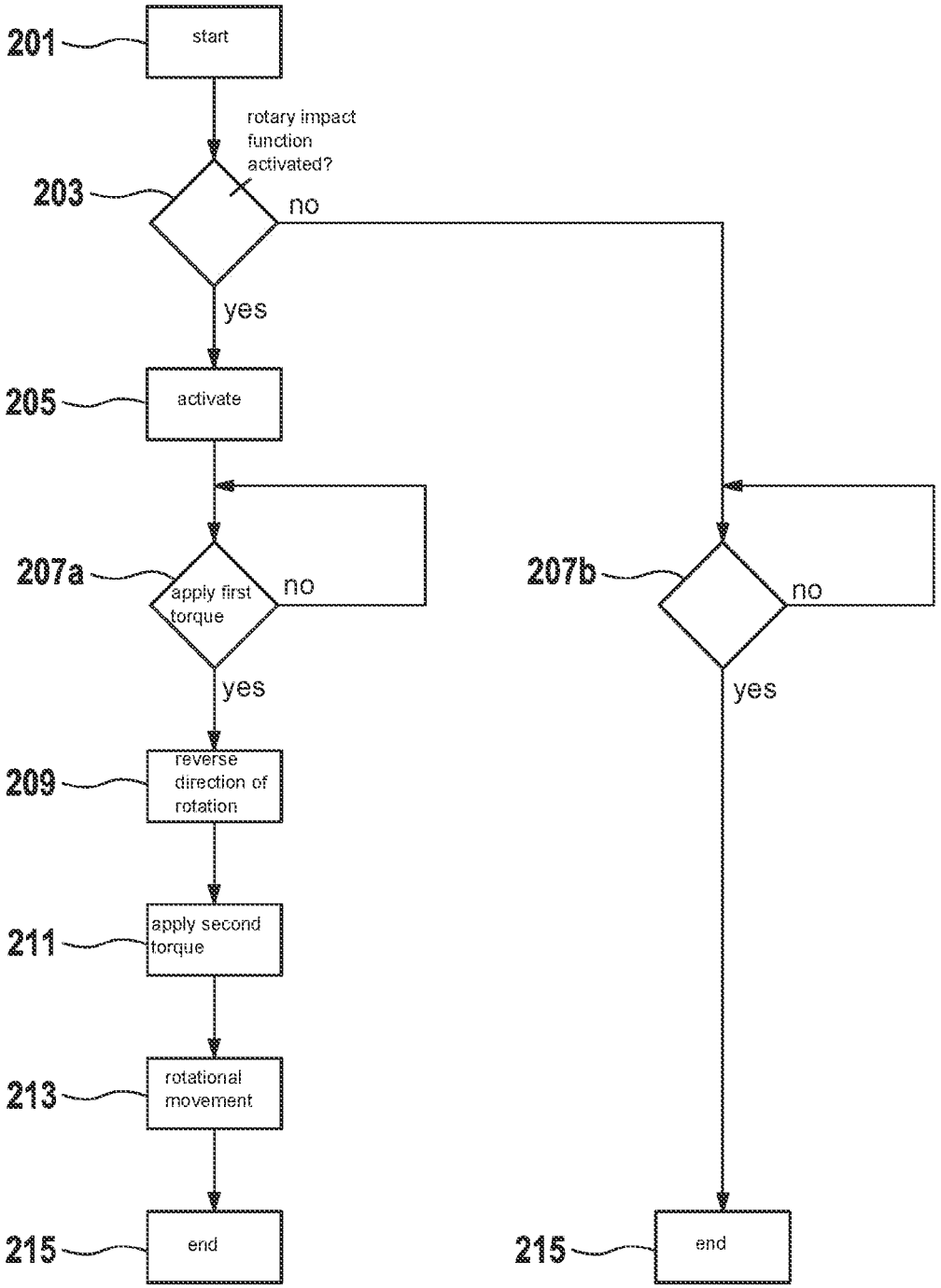
FIG. 3 shows a flow diagram of a method according to an example embodiment of the present invention.

Hand-held power tool 101 is provided to carry out a method for controlling or regulating a hand-held power tool 101, in particular a screwdriver, including at least the steps described in the following (FIG. 3).

In a step 201, the method is started, and in a further step 203 it is optionally checked whether a rotary impact function is activated, so that in the case of an activated rotary impact function step 205 is carried out, and in the case of a deactivated rotary impact function step **207*b*** is carried out.

If the rotary impact function is not activated, then in step 205 the rotary impact function is activated. For example, given the use of a rotary impact screwdriver the rotary impact function may not be capable of being deactivated, so that steps 203 and 205 are then omitted.

In a further step **207*a*, a first torque, in particular torque impulse, is applied to screw means (i.e., screw) 129 in a first direction of rotation. Here screw means 129 is to be tightened preferably up to a first target torque, or assembly torque. As a function of a state of actuation of the actuating element, such as an activated or a deactivated actuating element, or a functional state of the hand-held power tool, such as kickback activation, reaching a target torque, e-clutch, etc., a skip to step 209** can take place.

In order to screw in a screw means 129, the first torque is applied to screw means 129 in the first direction of rotation in order to tighten the screw for example to a desired depth or a desired torque.

Torque-transmitting region 131 is realized as a screw nut that is capable of being coupled to a driven unit of the hand-held power tool. The screw nut has an inner hexagonal cross-section, and the screw head has an outer hexagonal cross-section. Of course, a Torx bit and a Torx screw, hexagonal bit, and internal hexagonal screw can also be used.

In a further step 209, a direction of rotation of the drive unit is reversed, and in step 211 a second torque, in particular torque impulse, in a second direction of rotation that is opposite the first direction of rotation is applied to screw means 129.

The release of the jamming should take place here while avoiding a reduction in the first target torque, or of the assembly torque of screw means 129 in the first direction of rotation, so that it is ensured that the screw means does not detach.

The first direction of rotation is in the clockwise direction. The second direction of rotation is in the counterclockwise direction. The first direction of rotation and the second direction of rotation run opposite to one another.

The application of the first torque and/or of the second torque to screw means 129 can take place at least partly through a first torque impulse and/or a second torque impulse. Of course, there may be a plurality of torque impulses.

A number of torque impulses in the first and/or second direction of rotation can be set, so that the number of torque impulses that are to be applied to screw means 129 can be set.

The application of the second torque, in particular torque impulse, in the second direction of rotation to screw means 129 can take place as a function of an actuation, in particular an activation or a deactivation, of an actuating element 25 for controlling or regulating a drive unit of hand-held power tool 101. In particular, actuating element 25 is provided to control or to regulate the drive unit so that a compressed actuating element 25 is provided in order to tighten or screw in screw means 129.

The application of the second torque, in particular torque impulse, in the second direction of rotation to screw means 129 takes place as a function of an activation of a rotary impact function of hand-held power tool 101, because, in particular given the use of a rotary impact function, there is a high risk of jamming, so that hand-held power tool 101 preferably applies the second torque, in the second direction of rotation, to screw means 129 after each actuation, or screwing process, of hand-held power tool 101.

The rotary impact function can be set in step 203 so that when the rotary impact function is activated steps 205 through 215 are carried out.

For the ideal screwing in of screw means 129, the first target torque can be adjusted, so that the first target torque is provided in order to limit an application of the first torque, in particular torque impulse, to screw means 129 in the first direction of rotation. The first torque and/or the first target torque can be acquired electronically, for example via at least one sensor unit of hand-held power tool 101. For example, the torque could be measured via a drive current strength with which the drive unit is operated.

The method can include an application of the second torque, in particular torque impulse, to screw means 129 in the second direction of rotation as a function of, in particular, a reaching of the first target torque in the first direction of rotation. Here, a torque in a second direction of rotation can be applied to screw means 129 if, or after, screw means 129, with the first torque in the first direction of rotation, has reached or exceeded the first target torque, so that the direction of rotation is reversed after reaching or exceeding the first target torque.

The second torque, in particular torque impulse, in the second direction of rotation can be capable of being activated or deactivated by a switching button or an external device 119.

In addition, the method can regulate a provision of a time duration of the second torque, in particular torque impulse, acting on screw means 129 in the second direction of rotation, so that the drive unit is switched off if the second torque, in the second direction of rotation, is applied to screw means 129 with a time duration of up to 5 s.

The method can include a provision of a second target torque for limiting an application of the second torque, in particular torque impulse, to screw means 129 in the second direction of rotation. The second target torque can be adjustable in particular as a function of the first torque in the first direction of rotation. The first target torque should be, in the first direction of rotation, smaller than the second target torque in the second direction. Here the second target torque, in particular torque impulse, is smaller relative to the first target torque, in particular torque impulse, by up to 90% and by at least 70%. The second target torque, in particular torque impulse, can deviate from the first target torque, in particular torque impulse, by up to 30% and by at least 10%.

In step 213, the drive unit can have a rotational movement by an angle of rotation $\varphi$ in the second direction of rotation of up to 15°. Here an angle of rotation $\varphi$ can be greater than 2°.

In a further step 215, the method, or tightening process, ends.

In addition, hand-held power tool 101 has a communication unit 117 for receiving data from an external device 119 and for setting the data of hand-held power tool 101.

Communication unit 117 is provided to control or to regulate the drive unit in wireless fashion. Communication unit 117 has a first communication module that is situated on or in external device 119. Communication unit 117 has a second communication module that is situated on or in the hand-held power tool drive unit. Of course, second communication module is connected to electronics unit 37. Electronics unit 37 is provided to control or to regulate the drive unit. Electronics unit 37 is connected to the second communication module in particular electrically, or by electrical lines. Hand-held power tool 101 has at least one communication unit 117 for communication with at least one external unit, for an exchange of electronic data at least for controlling or regulating the drive unit. Communication unit 117 is preferably realized as a wireless communication unit 117. Here communication unit 117 is realized as a Bluetooth communication unit 117. Particularly preferably, electronics unit 37 is provided to control or to regulate the drive unit and/or safety functions of hand-held power tool 101 as a function of an actuation of the actuation unit and as a function of electronic data transmitted to electronics unit 37 by communication unit 117. The external unit is preferably realized as a smart phone that has an app for communication with communication unit 117. Settings stored in the external unit are thus preferably capable of being transmitted directly to hand-held power tool 101.

What is claimed is:

1. A method for controlling or regulating a hand-held power tool, the method comprising the following steps:

applying a first torque to a screw in a first direction of rotation; and applying a second torque to the screw in a second direction of rotation opposite to the first direction of rotation, wherein a first target torque is provided for limiting an application of the first torque to the screw in the first direction of rotation, wherein a second target torque is provided for limiting an application of the second torque to the screw in the second direction of rotation, wherein the second target torque is adjustable as a function of the first torque in the first direction of rotation.

2. The method as recited in claim 1, wherein the hand-held power tool is a rotary impact screwdriver.

3. The method as recited in claim 1, wherein the applying of the first torque includes applying one or a plurality of first torque impulses to the screw in the first direction of rotation.

4. The method as recited in claim 3, wherein a number of the first torque impulses in the first direction of rotation are set.

5. The method as recited in claim 3, wherein a number of the second torque impulses in the second direction of rotation are set.

6. The method as recited in claim 1, wherein the applying of the second torque includes applying one or a plurality of second torque impulses to the screw in the second direction of rotation.

7. The method as recited in claim 1, wherein the application of the second torque to the screw in the second direction of rotation takes place as a function of an actuation or a deactivation of an actuating element for controlling or regulating a drive unit of the hand-held power tool.

8. The method as recited in claim 1, wherein the application of the second torque to the screw in the second direction of rotation takes place as a function of an activation of a rotary impact function of the hand-held power tool.

9. The method as recited in claim 1, wherein the application of the second torque to the screw in the second direction of rotation is a function of a reaching of the first target torque in the first direction of rotation.

10. The method as recited in claim 1, wherein the application of the second torque to the screw in the second direction of rotation is capable of being activated or deactivated via a switching button or an external device.

11. The method as recited in claim 1, wherein a time duration of the second torque acting on the screw in the second direction of rotation is provided.

12. The method as recited in claim 1, wherein the second torque is smaller in relation to the first torque.

13. The method as recited in claim 1, wherein the second target torque is smaller relative to the first target torque by up to 95%.

14. The method as recited in claim 1, wherein the second target torque is smaller relative to the first target torque by up to 40%.

15. The method as recited in claim 1, wherein the second target torque is smaller relative to the first target torque by up to 30%.

16. The method as recited in claim 1, wherein the second target torque is smaller relative to the first target torque by 10%.

17. The method as recited in claim 1, wherein a rotational movement in the second direction of rotation has an angle of rotation of up to 20°.

18. The method as recited in claim 1, wherein a rotational movement in the second direction of rotation has an angle of rotation of up to 15°.

19. The method as recited in claim 1, wherein a rotational movement in the second direction of rotation has an angle of rotation of up to 10°.

20. The method as recited in claim 1, wherein a rotational movement in the second direction of rotation has an angle of rotation of up to 8°.

21. The method as recited in claim 1, wherein a rotational movement in the second direction of rotation has an angle of rotation of up to 5°.

22. A hand-held power tool configured to:

apply a first torque to a screw in a first direction of rotation; and apply a second torque to the screw in a second direction of rotation opposite to the first direction of rotation, wherein a first target torque is provided for limiting an application of the first torque to the screw in the first direction of rotation, wherein a second target torque is provided for limiting an application of the second torque to the screw in the second direction of rotation, wherein the second target torque is adjustable as a function of the first torque in the first direction of rotation.

23. The hand-held power tool as recited in claim 22, further comprising:

a communication unit configured to receive data from an external device and to set data of the hand-held power tool.

* * * * *